US009296207B2

(12) United States Patent
Sugimoto et al.

(10) Patent No.: US 9,296,207 B2
(45) Date of Patent: Mar. 29, 2016

(54) LIQUID DISCHARGE RECORDING APPARATUS AND METHOD FOR RECOVERING LIQUID

(71) Applicant: Brother Kogyo Kabushiki Kaisha, Nagoya-shi, Aichi-ken (JP)

(72) Inventors: Junichiro Sugimoto, Nagoya (JP); Noriaki Satoh, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/638,681

(22) Filed: Mar. 4, 2015

(65) Prior Publication Data

US 2015/0251428 A1 Sep. 10, 2015

(30) Foreign Application Priority Data

Mar. 5, 2014 (JP) ..... 2014-042415

(51) Int. Cl.
*B41J 2/165* (2006.01)

(52) U.S. Cl.
CPC ..... *B41J 2/16508* (2013.01); *B41J 2/16523* (2013.01); *B41J 2/16526* (2013.01); *B41J 2/16532* (2013.01)

(58) Field of Classification Search
CPC ..... B41J 2/16508; B41J 2/16511; B41J 2/16523; B41J 2/1721; B41J 11/0065
USPC ..... 347/29, 31, 84, 85, 95–100
See application file for complete search history.

(56) References Cited

U.S. PATENT DOCUMENTS

| | | | | |
|---|---|---|---|---|
| 8,795,424 | B2 | 8/2014 | Ozawa | |
| 2003/0058318 | A1 | 3/2003 | Sago et al. | |
| 2003/0107632 | A1 | 6/2003 | Arita et al. | |
| 2006/0109322 | A1 | 5/2006 | Nakazawa et al. | |
| 2007/0263054 | A1* | 11/2007 | Yatake | C09D 11/40 347/100 |
| 2010/0039483 | A1* | 2/2010 | Komatsu | B41J 11/0065 347/84 |
| 2010/0285287 | A1* | 11/2010 | Matsuyama | C09B 67/0033 428/207 |
| 2013/0155160 | A1 | 6/2013 | Shiono | |
| 2013/0215175 | A1 | 8/2013 | Ozawa | |

FOREIGN PATENT DOCUMENTS

| | | | |
|---|---|---|---|
| JP | 2003-096345 | A | 4/2003 |
| JP | 2003-191545 | A | 7/2003 |
| JP | 2003-327872 | A | 11/2003 |
| JP | 2006-168351 | A | 6/2006 |
| JP | 2006-241421 | A | 9/2006 |
| JP | 2013-199634 | A | 10/2013 |

OTHER PUBLICATIONS

Sciencelab.com, Inc., Material Safety Data Sheet, May 21, 2013, Sciencelab.com, Inc., Diethylene glycol MSDS, p. 1.*
OXEA Corporation, Material Safety Data Sheet, Feb. 16, 2007, OXEA Corporation, Trimethylolpropane, flake, p. 1.*
Mar. 4, 2015—U.S. Appl. No. 14/638,697, computer-generated English language translation obtained from IPDL of the JPO <http://www.ipdl.inpit.go.jp/homepg_e.ipdl>.
Sep. 16, 2015—(US) Non-Final Office Action—U.S. Appl. No. 14/638,697.
Sciencelab.com, Inc., Material Safety Data Sheet, May 21, 2013, Sciencelab.com, Inc., DL-1,2-Hexanediol MSDS, p. 1.
Sciencelab.com, Inc., Material Safety Data Sheet, May 21, 2013, Sciencelab.com, Inc., 1,5-Pentanediol MSDS, p. 1.

* cited by examiner

*Primary Examiner* — Manish S Shah
*Assistant Examiner* — Roger W Pisha, II
(74) *Attorney, Agent, or Firm* — Banner & Witcoff, Ltd.

(57) ABSTRACT

A liquid discharge recording apparatus includes: a first liquid containing trimethylolpropane; a liquid discharge head configured to discharge the first liquid; a second liquid containing a solvent of which freezing point is less than 20 degrees Celsius and of which specific gravity is not more than 1.12; and an absorber which is configured to contain the second liquid and which is configured to absorb the first liquid exited from the liquid discharge head, wherein a blending amount (% by weight) of the solvent in the second liquid is not less than a blending amount (% by weight) of the trimethylolpropane in the first liquid.

17 Claims, 3 Drawing Sheets

LIQUID DISCHARGE RECORDING APPARATUS AND METHOD FOR RECOVERING LIQUID

CROSS REFERENCE TO RELATED APPLICATION

The present application claims priority from Japanese Patent Application No. 2014-042415 filed on Mar. 5, 2014, the disclosure of which is incorporated herein by reference in its entirety.

BACKGROUND OF THE INVENTION

1. Field of the Invention

The present invention relates to a liquid discharge recording apparatus and a method for recovering liquid.

2. Description of the Related Art

A water-based ink for ink-jet recording (hereinafter referred to as a "water-based ink" or an "ink" in some cases), in which trimethylolpropane (TMP) is added for the purpose of improving the wettability thereof, has been suggested (see, for example, Japanese Patent Application Laid-open No. 2003-327872 and Japanese Patent Application Laid-open No. 2006-241421).

A water-based ink containing the TMP, however, easily aggregates and easily accumulates, for example, in an absorber which absorbs the water-based ink in a maintenance mechanism of a liquid discharge recording apparatus such as an ink-jet recording apparatus. The water-based ink containing the TMP and accumulated in the absorber contaminates a surface of an ink-jet head of the ink-jet recording apparatus and a recording paper (recording paper sheet) which is being conveyed (transported) in the ink-jet recording apparatus, in some cases.

An object of the present teaching is to provide a liquid discharge recording apparatus and a method for recovering a liquid which are capable of suppressing any contamination of a surface of the ink-jet head and of a recording paper which is being conveyed in the liquid discharge recording apparatus by suppressing any accumulation of the liquid containing the TMP.

SUMMARY OF THE INVENTION

According to a first aspect of the present teaching, there is provided a liquid discharge recording apparatus including:

a first liquid containing trimethylolpropane;

a liquid discharge head configured to discharge the first liquid;

a second liquid containing a solvent of which freezing point is less than 20 degrees Celsius and of which specific gravity is not more than 1.12; and an absorber which is configured to contain the second liquid and which is configured to absorb the first liquid exited from the liquid discharge head, wherein a blending amount (% by weight) of the solvent in the second liquid is not less than a blending amount (% by weight) of the trimethylolpropane in the first liquid.

According to a second aspect of the present teaching, there is provided a liquid-recovery method for recovering a liquid in a liquid discharge recording apparatus, the method including:

causing a first liquid containing trimethylolpropane to exit from a liquid discharge head of the liquid discharge recording apparatus; and recovering the first liquid by absorbing the first liquid exited from the liquid discharge head with an absorber which is provided in the liquid discharge recording apparatus and which contains a second liquid, the second liquid containing a solvent of which freezing point is less than 20 degrees Celsius and of which specific gravity is not more than 1.12;

wherein a blending amount (% by weight) of the solvent in the second liquid is not less than a blending amount (% by weight) of the trimethylolpropane in the first liquid.

DESCRIPTION OF THE PREFERRED EMBODIMENTS

Figure 1:
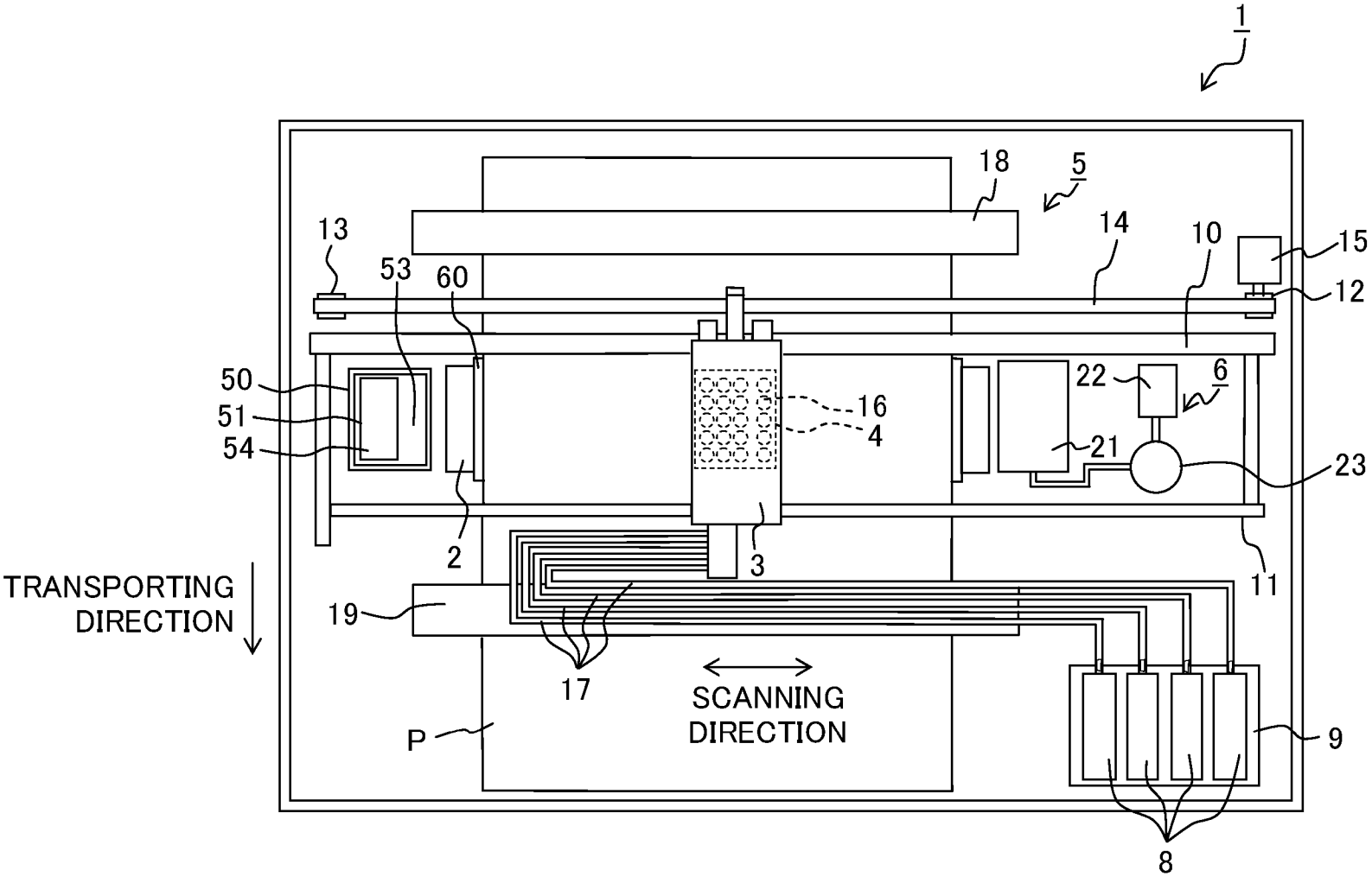
FIG. 1 is a schematic plane view depicting the configuration of an example of a liquid discharge recording apparatus of the present teaching.

A liquid discharge recording apparatus of the present teaching includes a first liquid containing trimethylolpropane (hereinafter referred to as "TMP" as appropriate); a liquid discharge head configured to discharge the first liquid; and an absorber which is configured to contain a second liquid and which is configured to absorb the first liquid exited from the liquid discharge head, the second liquid containing a solvent (hereinafter referred to as "specific solvent" as appropriate) of which freezing point is less than 20 degrees Celsius and of which specific gravity is not more than 1.12. The term "specific gravity" of the solvent in the present teaching means a value with respect to water of which temperature is 4 degrees Celsius. Further, in the specification, "the first liquid exited from the liquid discharge head" includes the first liquid which is discharged actively and made to exit from the nozzles, and the first liquid which is forced to exit from the nozzles as in the suction purge or push purge.

The first liquid usable in the liquid discharge recording apparatus of the present teaching includes, for example, a water-based ink for ink jet recording, a treatment solution (treatment liquid) used in the ink jet recording, etc. The treatment liquid is a liquid which is discharged to a recording medium before or after the discharge of ink, for the purpose of improving the quality of image (image quality), etc. Further, the first liquid is not limited to a liquid to be used for ink jet recording, and is exemplified, for example, by a shipping liquid (preservative liquid), an introductory liquid, an inspection liquid, etc. The shipping liquid is a liquid charged into a flow channel, of a liquid discharge recording apparatus, in a state of shipped out from the factory so as to preserve that state inside the flow channel. The introductory liquid is a liquid which is charged in advance into the flow channel of the liquid discharge recording apparatus in the factory upon shipment of the liquid discharge recording apparatus from the factory such that, when the liquid discharge recording apparatus is purchased by an user and the ink is introduced into the flow channel, the ink is easily introduced into the flow channel. The inspection liquid is a liquid to be used for inspecting the discharge of the liquid discharge head in the factory. As described above, the first liquid contains TMP. It is allowable to prepare the first liquid or to use any commercially available liquid product which contains TMP. According to the present teaching, it is possible to suppress the accumulation of the first liquid containing the TMP inside the liquid discharge recording apparatus. Therefore, for example, it is possible to add a necessary and sufficient amount of the TMP to an ink applied to the liquid discharge recording apparatus of the present teaching, thereby making it possible to improve the wettability as well.

In a case that the first liquid is an ink, the first liquid may contain at last one of a dye and a pigment as a colorant, among which the pigment is preferable as the colorant. Further, it is allowable that the ink does not contain any dye and contains substantially only a pigment, as the colorant. In a case that the colorant is the pigment and that the ink is discharged onto a surface of the absorber, there is a fear that the pigment might accumulate on the surface of the absorber. The liquid discharge recording apparatus of the present teaching, however, is capable of suppressing any accumulation of the pigment on the surface of the absorber. The blending amount of the colorant in the entire amount of the ink is not particularly limited, and may be appropriately determined based on, for example, desired optical density or color (hue, tint), etc. The blending amount of the colorant in the entire amount of the ink is, for example, in a range of 0.2% by weight to 20% by weight, and is preferably in a range of 2% by weight to 10% by weight. The blending amount of the TMP in the entire amount of the ink is not particularly limited, and is, for example, in a range of 0.1% by weight to 30% by weight, is preferably in a range of 0.5% by weight to 10% by weight, and is more preferably in a range of 1% by weight to 5% by weight. The ink may further contain any other conventionally known additive(s) exemplified by surfactants, rust-preventing agents, fungicides, etc., as necessary.

In a case that the first liquid is a liquid different from the ink, such as the treatment liquid, introductory liquid, shipping liquid (preservative liquid), inspection liquid, etc., it is allowable that the first liquid does not contain any colorant, or that the first liquid contains a colorant so that the presence of the first liquid can be visually confirmed. In a case that the first liquid which is different from the ink contains a colorant, the blending amount of the colorant in the first liquid is preferably not more than 0.5% by weight. In a case that the first liquid is the liquid different from the ink, such as the treatment liquid, introductory liquid, shipping liquid (preservative liquid), inspection liquid, etc., the blending amount of the TMP in the entire amount of the first liquid is not particularly limited, and is, for example, in a range of 0.1% by weight to 30% by weight, is preferably in a range of 0.5% by weight to 10% by weight, and is more preferably in a range of 1% by weight to 5% by weight.

Next, a liquid discharge recording apparatus and a liquid recovery method of the present teaching will be specifically explained. The liquid discharge recording apparatus of the present teaching includes a liquid discharge head which discharges a first liquid and an absorber which absorbs the first liquid exited from the liquid discharge head. The absorber is preferably at least one of a flushing foam and a platen foam, wherein the flushing absorber is arranged in a non-recording area of the liquid discharge recording apparatus, and the platen foam is arranged in a recording area of the liquid discharge recording apparatus. Namely, the absorber is preferably arranged at a position opposite to or facing the liquid discharge head in a scanning area of the liquid discharge head.

In the liquid discharge recording apparatus of the present teaching, the configuration of the liquid discharge recording apparatus, except for the absorber, may be similar to that of a conventional liquid discharge recording apparatus such as an ink-jet recording apparatus. The liquid recovery method of the present teaching is practiced by using the liquid discharge recording apparatus of the present teaching.

The absorber contains a second liquid. In the present teaching, the second liquid may be contained in the absorber before the absorber absorbs the first liquid so that the first liquid exited from the liquid discharge head can make contact with the second liquid in the absorber. Accordingly, it is allowable that the second liquid is contained, or is not contained, in the absorber upon shipment of the liquid discharge recording apparatus from the factory. For example, the second liquid may be charged into the liquid discharge head and the liquid flow channel, of the liquid discharge recording apparatus upon the shipment of the liquid discharge recording apparatus from the factory, and when a liquid for recording (recording liquid) is introduced to the liquid discharge head and the liquid flow channel, the second liquid may be discharged onto the absorber by using the liquid discharge head so that the second liquid is absorbed by the absorber. In this case, the viscosity of the second liquid preferably has a measurement value measured at 25 degrees Celsius that is in a range of 1 mPa·s to 10 mPa·s, more preferably in a range of 1.5 mPa·s to 8 mPa·s, further preferably in a range of 2 mPa·s to 5 mPa·s.

As described above, it is allowable that the second liquid is contained, or is not contained, in the absorber upon shipment of the liquid discharge recording apparatus from the factory. However, at least for the following reason, the second liquid is preferably contained in the absorber upon shipment of the liquid discharge recording apparatus from the factory. Namely, in a case that the second liquid is not contained in the absorber upon shipment of the liquid discharge recording apparatus from the factory, the second liquid is discharged by the liquid discharge head as described above. In this case, the second liquid is required to have a physical property to be dischargeable with the liquid discharge head. Accordingly, there is a fear that the second liquid might not be able to contain the specific solvent in any sufficient content ratio. This is particularly problematic in a case that an ink jet head of the thermal ink jet system is used as the liquid discharge head. Further, there is a fear that it might be difficult to allow the absorber to contain the second liquid in any sufficient amount. On the other hand, in such a case that the second liquid is previously contained in the absorber upon shipment of the liquid discharge recording apparatus from the factory, the second liquid is allowed to contain the specific solvent in a sufficient content ratio, and it is also easy to allow the absorber to absorb the second liquid in a sufficient amount.

The second liquid contains the specific solvent of which freezing point is less than 20 degrees Celsius and of which specific gravity is not more than 1.12. The specific solvent of which freezing point is less than 20 degrees Celsius is in a liquid state at a temperature in the vicinity of the room temperature. In the absorber, the first liquid makes contact with the specific solvent in the liquid state, thereby suppressing any deposition and accumulation of a component, in the first liquid, such as the TMP, the colorant, etc., and promoting the absorption of the first liquid into the absorber. Further, in view of promoting the absorption of the first liquid into the absorber, the freezing point of the specific solvent is preferably less than 10 degrees Celsius, is more preferably less than 0 degrees Celsius, and is furthermore preferably less than −40 degrees Celsius. Moreover, in a case that the freezing point of the specific solvent is less than 5 degrees Celsius, the accumulation of the first liquid containing TMP can be suppressed even under an environment of 5 degrees Celsius, and thus the liquid-recovery method of the present teaching can be practiced also at a low temperature. Further, the freezing point of the specific solvent is preferably not less than −80 degrees Celsius.

Further, since the specific gravity of the specific solvent is small, namely not more than 1.12, the first liquid absorbed by the absorber permeates under the specific solvent, thereby suppressing any deposition and accumulation of a component, in the first liquid, such as the TMP, the colorant, etc., and promoting the absorption of the first liquid into the absorber. Further, in view of the affinity of the specific solvent relative to the first liquid absorbed by the absorber, the specific gravity of the specific solvent is preferably not less than 0.85. Furthermore, the specific gravity of the specific solvent is preferably smaller than the specific gravity of the first liquid.

In the present teaching, for example, in a case that the absorber is a flushing foam and a platen foam, the accumulation of the first liquid on the surface of the absorber is suppressed. With this, it is possible to suppress any clogging (of nozzles) in the liquid discharge head caused due to the first liquid which is accumulated on the surface of the absorber and which makes contact with the liquid discharge head. Further, it is also possible to suppress any contamination of a recording medium, such as a recording paper or paper sheet, etc., caused due to the first liquid which is accumulated on the surface of the absorber and which makes contact with the recording medium.

Any substance can be used as the specific solvent, provided such a substance has a freezing point of less than 20 degrees Celsius and a specific gravity of not more than 1.12. However, as the specific solvent, it is preferable to use polyhydric alcohol, glycol ether, a nitrogen-containing compound and fatty acid. Further, the specific solvent is preferably a water-soluble solvent. The specific solvent is exemplified, for example, by diethylene glycol (DEG), triethylene glycol n-butyl ether (BTG), N-methyl-2-pyrrolidone (N-methyl-2P), 1,5-pentanediol (1,5-PD), 1,3-dimethyl-2-imidazolidinone, oleic acid, triethylene glycol (TEG), tetraethylene glycol n-butyl ether, propylene glycol n-butyl ether, dipropylene glycol n-butyl ether, tripropylene glycol n-butyl ether, dipropylene glycol n-propyl ether, linoleic acid, etc. The specific solvent is preferably at least one of the DEG and BTG. It is allowable that only one kind of the specific solvent is used singly, or that two or more kinds of the specific solvent are used in a mixed manner. TABLE 1 as follows indicates the freezing points and specific gravities of the representative specific solvents.

TABLE 1

| | Freezing Point (degrees Celsius) | Specific Gravity |
|---|---|---|
| Diethylene glycol (DEG) | −68 | 1.118 |
| Triethylene glycol n-butyl ether (BTG) | −48 | 0.9866 |
| N-methyl-2-pyrrolidone (N-methyl-2P) | −23 | 1.027 |
| 1,5-pentanediol (1,5-PD) | −18 | 0.99 |
| 1,3-dimethyl-2-imidazolidinone | 8 | 1.06 |
| Oleic acid | 10 | 0.90 |
| Triethylene glycol (TEG) | 9.4 | 1.12 |
| Propylene glycol n-butyl ether | <−75 | 0.88 |
| Dipropylene glycol n-butyl ether | <−75 | 0.94 |
| Tripropylene glycol n-butyl ether | <−60 | 0.92 |
| Dipropylene glycol n-butyl ether | <−60 | 0.92 |
| Linoleic acid | −5 | 0.90 |

The second liquid may be composed only of the specific solvent, or may contain other solvent, such as water, etc., which is different from the specific solvent. The second liquid may be an aqueous solution of the specific solvent. The water is preferably ion-exchange water or pure water (purified water). In view of the suppressing the accumulation of the first liquid into the absorber, the blending amount of the specific solvent in the entire amount of the second liquid is, for example, in a range of not less than 10% by weight, is preferably in a range of not less than 50% by weight, and is more preferably in a range of not less than 80% by weight. Further, in view of suppressing the accumulation of the first liquid into the absorber, the blending amount (% by weight) of the specific solvent in the second liquid is not less than 1 time the blending amount (% by weight) of the TMP in the first liquid. Namely, the blending amount (% by weight) of the specific solvent in the second liquid is not less than the blending amount (% by weight) of the TMP in the first liquid. The blending amount of the specific solvent in the second liquid is preferably not less than 5 times, and is more preferably not less than 10 times the blending amount of the TMP contained in the first liquid. Further, the blending amount of the specific solvent in the second liquid is not more than 50 times the blending amount of the TMP in the first liquid, and is preferably not more than 20 times the blending amount of the TMP in the first liquid.

In the liquid discharge recording apparatus of the present teaching, the absorber which absorbs the first liquid exited from the liquid discharge head may be any absorber provided that the absorber is capable of absorbing the first liquid. For example, the absorber is exemplified by melamine foam, urethane foam, polyethylene foam, silicone foam, acrylic foam, chloroprene rubber (CR) sponge, natural rubber (NR) sponge, nitrile rubber (NBR) sponge, ethylene propylene diene rubber (EPDM) sponge, felt foam, needle felt among which melamine foam is preferable.

The absorber absorbs the first liquid exited from the liquid discharge head. The method for causing the absorber to absorb the first liquid is not particularly limited; it is allowable, for example, to cause the absorber to absorb the first liquid by discharging the first liquid toward the absorber by a liquid discharge head such as an ink jet head or to allow the absorber to absorb the first liquid sucked from the liquid discharge head by a suction pump, as will be described below.

FIG. 1 depicts the configuration of an example of the liquid discharge recording apparatus of the present teaching. As depicted in FIG. 1, a liquid discharge recording apparatus 1 of the present teaching includes a platen 2, a carriage 3, an ink-jet head (liquid discharge head) 4, a conveying mechanism 5 and a maintenance unit 6 as main constitutive components or parts. The ink-jet head 4 may be of any system including the piezoelectric element system, the thermal ink-jet system, the electrostatic attraction system, etc.

A recording medium (for example, recording paper or recording sheet) P supplied from a paper feeding mechanism (not depicted in the drawings) is placed on the upper surface of the platen 2. Two guide rails 10 and 11 are arranged at a position above or over the platen 2, and extend parallel to each other in the scanning direction (left/right direction in FIG. 1). The carriage 3 is movable in a reciprocating manner in the scanning direction along the two guide rails 10 and 11 in an area at which the carriage 3 faces or is opposite to the platen 2.

The two guide rails 10 and 11 extend in the scanning direction to further protrude from the left and right ends of the platen 2. The carriage 3 is configured to be movable from the area facing the recording paper P on the platen 2 (recording area) to a position located away from both of the left/right ends of the platen 2 (non-recording area). An endless belt 14 wound between two pulleys 12 and 13 is connected to the carriage 3. By driving the endless belt 14 to run by a carriage driving motor 15, the carriage 3 is reciprocated in the scanning direction, accompanying with the running of the endless belt 14.

The ink-jet head 4 is installed in a lower portion of the carriage 3. The lower surface of the ink-jet head 4 is a liquid discharge surface 4*a* (see FIG. 2) which is parallel to the upper surface of the platen 2 and in which a plurality of nozzles 16 are opened. An ink is discharged from the plurality of nozzles 16 of the liquid discharge surface 4*a* toward the recording paper P placed on the platen 2 so as to perform recording on the recording paper P.

Four ink supply ports (not depicted in the drawings) corresponding to colors of black, yellow, cyan and magenta, respectively are provided on the upper surface of the ink-jet head 4, and one ends of four tubes 17 are connected to the four ink supply ports, respectively. The other ends of the four tubes 17 are connected to a cartridge installation section 9 that is configured such that four ink cartridges 8 storing the four color inks respectively are detachably attached to the cartridge installation section 9. With this configuration, the inks of the respective four colors are supplied to the ink-jet head 4 from the four ink cartridges 8 installed in the cartridge installation section 9 via the four tubes 17, respectively. In the liquid discharge recording head 1, at least an ink of one color, among the inks of four colors, may be the first liquid containing the TMP.

The conveying mechanism 5 has two conveying rollers 18 and 19 which are arranged so as to sandwich the platen 2 therebetween in a conveying direction (direction from the upper portion to the lower portion on the sheet surface in FIG. 1). The recording paper P placed on the platen 2 is conveyed in the conveying direction by the two conveying rollers 18 and 19.

The liquid discharge recording apparatus 1 discharges the ink (first liquid) from the ink-jet head 4 installed in the carriage 3 toward the recording paper P placed on the platen 2 and conveys the recording paper P in the conveying direction by the two conveying rollers 18 and 19, thereby recording desired image and/or letter, etc., on the recording paper P.

Next, the maintenance unit 6 will be explained. The maintenance unit 6 includes a purge unit and a flushing unit. The purge unit has a waste liquid foam 22, a suction cap 21 and a suction pump 23 which are arranged on one side in the scanning direction (on the right side in FIG. 1) with respect to the platen 2. The flushing unit is arranged on the other side in the scanning direction (on the left side in FIG. 1) with respect to the platen 2, and includes a first flushing foam 53, a second flushing foam 54, a waste liquid tank 50 and a liquid receiving member 51, as main constitutive components or parts.

The suction cap 21 is driven by a cap driving mechanism including a driving mechanism such as a motor (not depicted) so that the suction cap 21 is driven to move in the up and down direction and to make approach/separation with respect to the liquid discharge surface 4*a*. The suction pump 23 is connected to the suction cap 21. When the suction cap 21 makes contact with the liquid discharge surface 4*a*, the suction cap 21 covers the openings of the plurality of nozzles 16. In a case that the suction cap 21 is in a capping state in such a manner, the suction pump 23 is driven to perform suction and depressurization in the inside of the suction cap 21, thereby causing the liquid(s) such as the ink(s) to exit from all of the nozzles 16 covered by the suction cap 21 (suction purge). The suction pump 23 is connected to the waste liquid foam 22. The first liquid sucked and made to exit from the nozzles 16 by the suction purge is absorbed by the waste liquid foam 22 via the suction pump 23. Although not depicted in the drawings, the waste liquid foam 22 is accommodated in a box which is open at an upper portion of the box. The waste liquid foam 22 may be any member provided that such a member is capable of absorbing the liquid (first liquid), such as, for example, a foam member including a melamine foam, etc. In the embodiment, the purge unit is configured to suck the first liquid from the nozzles 16 by the suction pump 23. However, the purge unit may be configured as a so-called "push purge" mechanism which applies pressure to the first liquid inside the ink jet head 4 to thereby cause the first liquid to exit from the nozzles 16. Namely, the first liquid absorbed by the absorber in the present teaching may be the first liquid which is discharged actively and made to exit from the nozzles, or the first liquid which is forced to exit from the nozzles as in the suction purge. Alternatively, in the present teaching, it is allowable to provide such an aspect for the absorption of the first liquid wherein the absorber receives the first liquid discharged directly to the absorber.

Figure 2:
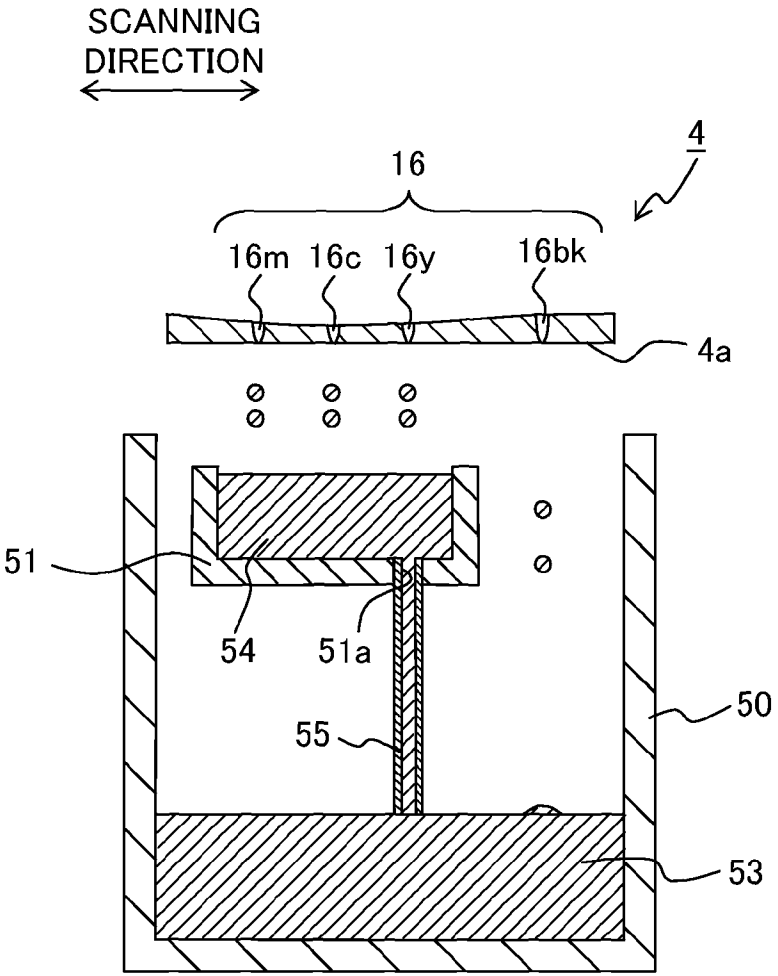
FIG. 2 is a cross-sectional view of a waste liquid tank in a vertical plane including a scanning direction for the liquid discharge recording apparatus depicted in FIG. 1 when the liquid discharge recording apparatus performs liquid recovery operation.

As depicted in FIG. 2, the waste liquid tank 50 has a box-shape which is open at an upper portion thereof, and accommodates the first flushing foam 53 inside of the waste liquid tank 50. The liquid receiving member 51 is arranged at a position above or over the first flushing foam 53. The liquid receiving member 51 has a box-shape which is open at an upper portion thereof, and accommodates the second flushing foam 54 inside of the liquid receiving member 51. A discharge port 51*a* is formed in the liquid receiving member 51 at a portion on the bottom surface and located on one side in the scanning direction (on the right side in FIG. 2). The discharge port 51*a* is connected to one end of a tube 55 of which other end makes contact with the upper surface of the first flushing foam 53. With this, the first liquid absorbed by the upper surface of the second flushing foam 54 moves downwardly and is discharged from the discharge port 51*a* to the first flushing foam 53, via the tube 55. Each of the first and second flushing foams 53 and 54 may be any member provided that such a member is capable of absorbing the first liquid, such as, for example, a foam member including a melamine foam, etc.

Figure 3A:
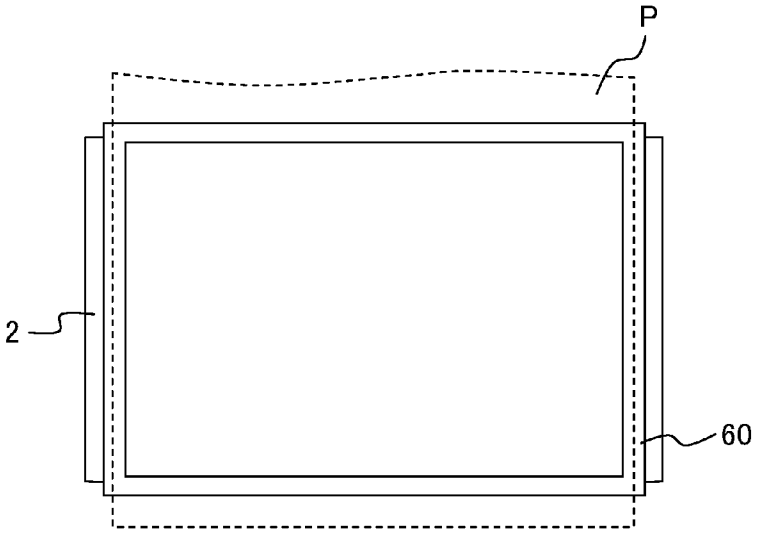
FIG. 3A is a plane view of a platen and a platen foam of the liquid discharge recording apparatus depicted in FIG. 1.
Figure 3B:
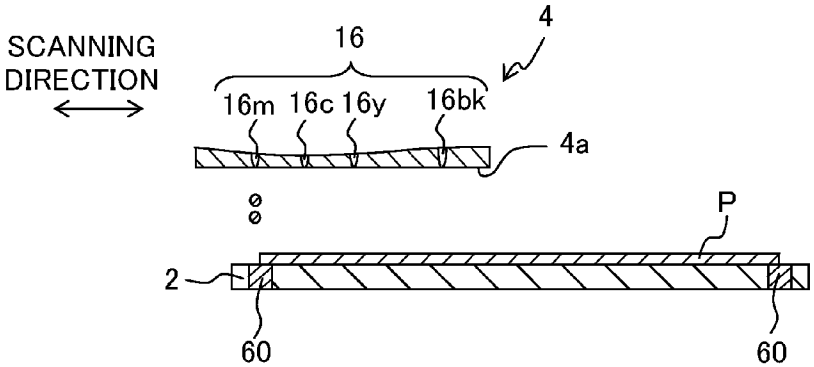
FIG. 3B is a cross-sectional view of the platen and the platen foam in the vertical plane including the scanning direction when the liquid discharge recording apparatus depicted in FIG. 1 performs the liquid recovery operation.

Next, a platen foam 60 will be explained with reference to FIGS. 3A and 3B. FIG. 3A is a plan view of the platen 2 and the platen foam 60, and FIG. 3B is a cross-sectional view of the platen 2 and the platen foam 60 in the vertical plane including the scanning direction when the liquid is being recovered (during a liquid recovery operation). Note that in FIG. 3A, the recording paper P is depicted by broken lines, and the lower portion of the recording paper P is depicted in phantom. As depicted in FIGS. 3A and 3B, the platen foam 60 having a rectangular cylindrical shape is integrated into the platen 2 at a lower portion of an area in which an end or edge portion of the recording paper P passes. With this, in case of performing for example a borderless recording with respect to the recording paper P, it is possible to absorb, with the platen foam 60, the first liquid discharged onto the upper surface of the platen 2 beyond the end portion of the recording paper P. The platen foam 60 may be any member provided that such a member is capable of absorbing the first liquid, such as, for example, a foam member including a melamine foam, etc. Further, the shape of the platen foam 60 is not limited to the shape of rectangular cylindrical shape depicted in FIGS. 3A and 3B, and the platen foam 60 may have any shape provided that the platen foam 60 is capable of absorbing the first liquid discharged beyond the end portion of the recording paper P.

The first flushing foam 53, the second flushing foam 54, the waste liquid foam 22 and the platen foam 60 absorb the second liquid containing the specific solvent. In each of the first and second flushing foams 53 and 54 and the platen foam 60, the second liquid may be contained only at a portion which makes contact with the first liquid discharged from the ink-jet head 4, or may be contained in the entirety of each of the first and second flushing foams 53 and 54 and the platen foam 60. Further, each of the first flushing foam 53, the second flushing foam 54, and the platen foam 60 may be provided independently (separately) respectively for the colors of the first liquids (such as inks) discharged from the ink-jet head 4. In such a case, the blending amount of the specific solvent contained in the second liquid contained in each of the first flushing foam 53, the second flushing foam 54, and the platen foam 60 may be determined depending on the content amount of the TMP contained in one of the discharged first liquids.

Next, an example of the liquid recovery method of the present teaching will be explained with reference to FIG. 2. The example depicted in FIG. 2 is an aspect wherein the first liquid is recovered by discharging the first liquid from the ink-jet head 4 directly to the flushing foam. In this aspect, at least an ink of one color, among the inks of the four colors, is the first liquid containing the TMP. FIG. 2 is a cross-sectional view of the waste liquid tank 50 in a vertical plane including the scanning direction when the liquid discharge recording apparatus 1 depicted in FIG. 1 performs liquid recovery operation. In FIG. 2, reference numerals "16*bk*", "16*y*", "16*c*" and "16*m*" indicate nozzles 16 for black, yellow, cyan and magenta inks, respectively. In the liquid discharge recording apparatus 1, the ink jet head 4 may further have a nozzle and a supply port for a treatment liquid. The liquid discharge recording apparatus 1 may further have a cartridge in which the treatment liquid is stored and a tube for supplying the treatment liquid. In this case, the treatment liquid may be the first liquid containing the TMP.

When the liquid is recovered in this example, the ink jet head 4 is stopped, without scanning in the scanning direction, and the ink(s) (first liquid) discharged from the nozzles 16 is (are) discharged immediately downwardly. FIG. 2 depicts an example wherein liquid recovery for recovering the black ink from the nozzle 16*bk* and liquid recovery for recovering the three color inks that are yellow, cyan and magenta inks from the nozzles 16*y*, 16*c* and 16*m* are performed at the same time. A timing for discharging the ink(s) is exemplified by a timing before starting the recording on recording paper P, a timing between the paper sheets during a continuous recording (from a point of time after completing recording on one sheet of the recording paper P and until a point of time starting the recording on next sheet of the recording paper P), etc.

In FIG. 2, the first liquids (inks) are recovered by discharging the inks of the respective colors that are the black ink and the yellow, cyan and magenta inks from the nozzle 16*bk* of the black ink and the nozzles 16*y*, 16*c* and 16*m* of the three color inks toward the first flushing foam 53 accommodated in the waste liquid tank 50 and the second flushing foam 54 accommodated in the liquid receiving member 51, respectively, at a position at which the nozzle 16*bk* of the black ink is made to face or to be opposite to the first flushing foam 53, and at which the nozzles 16*y*, 16*c* and 16*m* of the three color inks are made to face the second flushing foam 54. Note that the liquid recovery of the liquid from the nozzle 16*bk* of the black ink and the liquid recovery of the liquids from the nozzles 16*y*, 16*m*, and 16*c* of the three color inks may be performed separately from each other. Further, in a case that the ink jet head 4 has the nozzle for the treatment liquid, liquid recovery of the treatment liquid from the nozzle for the treatment liquid can also be performed by moving the nozzle for the treatment liquid to a position facing or to be opposite to the first or second flushing foam 53 or 54, in a similar manner as for the recovery of the inks. In view of allowing the first liquids to sufficiently permeate into the first and second flushing foams 53 and 54, the amount of the second liquid contained in each of the first and second flushing foams 53 and 54 is preferably not less than 0.10 $\mu g/mm^3$, and in view of suppressing any flooding of the second liquid in such a case that any reaction force is applied to each of the first and second flushing foams 53 and 54 during transportation, etc., the amount of the second liquid contained in each of the first and second flushing foams 53 and 54 is preferably not more than 0.91 $\mu g/mm^3$. In view of retaining the second liquid to each of the first and second flushing foams 53 and 54 while allowing the first liquid to permeate into each of the flushing foams 53 and 54, the amount of the second liquid contained in each of the first and second flushing foams 53 and 54 is more preferably in a range of not less than 0.20 $\mu g/mm^3$ to not more than 0.70 $\mu g/mm^3$.

Further, the amount of the specific solvent in the second liquid contained in the absorber may be determined depending on the amount of the TMP contained in the first liquid, the service life period of the liquid discharge recording apparatus, etc. For example, in a case that the absorber is a flushing foam of the liquid discharge recording apparatus, the amount of the specific solvent in the flushing foam is preferably not less than 0.10 g, more preferably not less than 0.18 g, and is preferably not more than 0.81 g, more preferably not more than 0.63 g.

Since the second liquid containing the specific solvent is contained in each of the first flushing foam 53 and the second flushing foam 54 and the blending amount (% by weight) of the specific solvent in the second liquid is not less than 1 time the blending amount (% by weight) of the TMP in the first liquid, it is possible to suppress the accumulation of the first liquid containing the TMP.

Next, another example of the liquid recovery method of the present teaching will be explained with reference to FIG. 1. In this aspect, the introductory liquid is charged into the ink flow channel and the ink-jet head 4, and the introductory liquid is the first liquid. In this case, the ink-jet head 4 in its initial state of being capped by the suction cap 21 is moved to a position immediately above the flushing foam before the liquids used for the ink jet recording such as the ink(s) and the treatment liquid, etc., are introduced from the ink cartridge(s) 8 to the ink flow channel. Further, the ink jet head 4 is driven so as to discharge the introductory liquid from the plurality of nozzles 16 onto the second flushing foam 54. After the introductory liquid inside the ink flow channels in the ink-jet head 4 and the tubes 17 has been discharged to the second flushing foam 54, then, the inks are introduced from the ink cartridges 8 into the ink flow channels. The viscosity of the introductory liquid preferably has a measurement value measured at 25 degrees Celsius in a range of 1 mPa·s to 10 mPa·s, more preferably in a range of 1.5 mPa·s to 8 mPa·s, further preferably in a range of 2 mPa·s to 5 mPa·s. Similarly, the viscosity of each of the shipping liquid and the inspection liquid is preferably in the above-listed range and preferred ranges regarding the viscosity of the introductory liquid.

Next, still another example of the liquid recovery method of the present teaching will be explained with reference to FIG. 3B. The example depicted in FIG. 3B is an aspect wherein the first liquid is recovered by discharging the first liquid from the ink-jet head 4 directly to the platen foam 60.

In FIG. 3B, same parts or portions as those in FIG. 2 are assigned with same reference numerals as those in FIG. 2.

At first, a case that the first liquid is an ink will be explained. When the liquid is recovered in this example, the ink-jet head 4 is stopped, without scanning in the scanning direction, and the ink(s) (first liquid) discharged from the nozzles 16 are discharged immediately downwardly. FIG. 3B depicts an example wherein the liquid is recovered from the nozzle 16*m* for the magenta ink.

In FIG. 3B, the first liquid (magenta ink) is recovered by discharging the magenta ink from the nozzle 16*m* of the magenta ink toward the platen foam 60 integrated into the platen 2, at a position at which the nozzle 16*m* is made to face or to be opposite to the platen foam 60. Note that the recovery of the liquids from the nozzles 16*bk*, 16*y* and 16*c* can also be performed by moving the nozzles 16*bk*, 16*y* and 16*c* to positions at each of which one of the nozzles 16*bk*, 16*y* and 16*c* faces the platen foam 60, in a similar manner as for the recovery of the magenta ink from the nozzle 16*m*. Further, in a case that the ink-jet head 4 has the nozzle for the treatment liquid, liquid recovery of the treatment liquid from the nozzle for the treatment liquid can also be performed by moving the nozzle for the treatment liquid to a position facing or to be opposite to the platen foam 60, in a similar manner as for the recovery of the ink(s). In this case, the treatment liquid may be the first liquid.

Next, an explanation will be given about a case that the first liquid is the introductory liquid charged into the ink flow channel and the ink jet head 4. In this case, the ink-jet head 4 in its initial state of being capped by the suction cap 21 is moved to a position immediately above the platen foam 60 before the liquids used for the ink-jet recording such as the ink(s) and the treatment liquid, etc., are introduced from the ink cartridge(s) 8 to the ink flow channel. Further, the ink-jet head 4 is driven so as to discharge the introductory liquid from the plurality of nozzles 16 onto the platen foam 60. Although it is allowable that the entire (all) amount of the introductory liquid is discharged to the platen foam 60, it is preferable that not all the amount of the introductory liquid is discharged and that an appropriate amount of the introductory liquid is retained without being discharged. After the introductory liquid inside the ink flow channels in the ink-jet head 4 and the tubes 17 has been discharged to the platen foam 60, then, the inks are introduced from the ink cartridges 8 into the ink flow channels.

In view of sufficiently allowing the first liquid to permeate into the platen foam 60, the amount of the second liquid contained in the platen foam 60 is preferably not less than 0.10 μg/mm$^3$, and in view of suppressing any flooding of the second liquid in such a case that any reaction force is applied to the platen foam 60 during transportation, etc., the amount of the second liquid contained in the platen foam 60 is preferably not more than 0.91 μg/mm$^3$. In view of retaining the second liquid to the platen foam 60 while allowing the first liquid to permeate into the platen foam 60, the amount of the second liquid contained in the platen foam 60 is preferably in a range of not less than 0.20 μg/mm$^3$ to not more than 0.70 μg/mm$^3$.

Since the second liquid containing the specific solvent is contained in the platen foam 60 and the blending amount (% by weight) of the specific solvent in the second liquid is not less than 1 time the blending amount (% by weight) of the TMP in the first liquid, it is possible to suppress the accumulation of the first liquid containing the TMP.

As described above, according to the present teaching, it is possible to suppress the accumulation of the first liquid containing the TMP in the liquid discharge recording apparatus by allowing the absorber, configured to absorb the first liquid containing the TMP, to absorb the second liquid containing the solvent of which freezing point is less than 20 degrees Celsius and of which specific gravity is not more than 1.12; and further by making the blending amount (% by weight) of the solvent in the second liquid be not less than 1 time the blending amount (% by weight) of the TMP in the first liquid.

EXAMPLES

Next, examples of the present teaching will be explained together with comparative examples. Note that the present teaching is not limited and is not restricted to the examples and the comparative examples which will be described below.

[Preparation of Ink]

Components, except for a self-dispersible pigment, which were included in Ink Composition (TABLE 2 as indicated below) were mixed uniformly or homogeneously; and thus an ink solvent was obtained. Subsequently, the ink solvent was added to the self-dispersible pigment dispersed in water, followed by being mixed uniformly. After that, the obtained mixture was filtrated through a cellulose acetate membrane filter (pore size 3.00 μm) produced by Toyo Roshi Kaisha, Ltd., and thus inks 1 and 2 for ink-jet recording were obtained.

TABLE 2

| | | INKS | |
|---|---|---|---|
| | | Ink 1 | Ink 2 |
| Ink Composition (unit: % by weight) | CAB-O-JET (trade name) 300 (*1) | 40 | 40 |
| | TMP | 5 | 10 |
| | Glycerol | 20 | 20 |
| | Water | balance | balance |

(*1): Self-dispersible black pigment (produced by Cabot Corporation, pigment solid content: 15% by weight)

[Preparation of Second Liquid]

Second liquids 1 to 10 having the compositions indicated in TABLE 3 as below were prepared.

TABLE 3

| | | SECOND LIQUIDS | | | | | | | | | |
|---|---|---|---|---|---|---|---|---|---|---|---|
| | | 1 | 2 | 3 | 4 | 5 | 6 | 7 | 8 | 9 | 10 |
| Composition of second liquid (unit: % by weight) | DEG | 100 | 50 | — | — | — | 10 | 5 | — | — | 8 |
| | BTG | — | — | 100 | 50 | — | — | — | — | — | — |
| | N-methyl-2P | — | — | — | — | 100 | — | — | — | — | — |
| | Glycerol | — | — | — | — | — | — | — | 100 | — | — |
| | Urea | — | — | — | — | — | — | — | — | 100 | — |
| | Water | — | 50 | — | 50 | — | 90 | 95 | — | — | 92 |

Examples 1-7 and Comparative Examples 1-4

100 μL of each of the second liquids 1-10 as indicated in TABLE 4 as follows was permeated into a melamine foam (surface area: 1 $cm^2$, thickness: 5 mm), and then one of the inks 1 and 2 was used in combination with the second liquid as indicated in TABLE 4 as follows, so as to perform the evaluation of accumulation in accordance with the following method.

[Method of Evaluating Accumulation]

An ink jet recording apparatus "MFC-J6910CDW", manufactured by Brother Kogyo Kabushiki Kaisha and having the melamine foam as described above arranged therein as a platen foam, was prepared. The ink 1 or 2 used in each of Examples 1-7 and Comparative Examples 1-4 was poured into an empty ink tank and the ink tank was installed in a tank holder of the ink jet recording apparatus MCF-J6910CDW so as to discharge the ink 1 or 2 from the ink jet head of the ink-jet recording apparatus MFC-J6910CDW. After that, the ink-jet recording apparatus was connected to a host computer, a "borderless printing" was selected by a printer driver, and a sample image ISO/JIS-SCID (N3 fruit) was printed continuously on 500 sheets of Glossy Photo Paper "BP71", L size, manufactured by Brother Kogyo Kabushiki Kaisha. After the recording, the melamine foam and the back surface of the glossy photo paper were observed, and the evaluation of accumulation was performed in accordance with the following evaluation criterion.

<Evaluation Criterion for Accumulation>

AA: No accumulation of the ink was observed on the melamine foam (platen foam), and no contamination on the back surface of the glossy photo paper was observed in 500 sheets of the glossy photo paper.

A: No accumulation of the ink was observed on the melamine foam (platen foam), but contamination on the back surface of the glossy photo paper was observed in not more than 2 sheets among 500 sheets of the glossy photo paper.

B: Accumulation of the ink was observed on the melamine foam (platen foam), and contamination on the back surface of the glossy photo paper was observed in 3 to 49 sheets among 500 sheets of the glossy photo paper.

C: Accumulation of the ink was observed on the melamine foam (platen foam), and contamination on the back surface of the glossy photo paper was observed in not less than 50 sheets among 500 sheets of the glossy photo paper.

The compositions of the inks and second liquids used in Examples 1 to 7 and Comparative Examples 1 to 4 and the results of evaluation are indicated in TABLE 4 as follows.

TABLE 4

| | EXAMPLES | | | | | | |
|---|---|---|---|---|---|---|---|
| | EX. 1 | EX. 2 | EX. 3 | EX. 4 | EX. 5 | EX. 6 | EX. 7 |
| Ink | Ink 1 | Ink 1 | Ink 1 | Ink 1 | Ink 2 | Ink 2 | Ink 2 |
| (A) Blending amount of TMP (% by weight) | 5 | 5 | 5 | 5 | 10 | 10 | 10 |
| Second liquid | 1 | 2 | 3 | 4 | 5 | 2 | 6 |
| Solvent | DEG | DEG | BTG | BTG | N-methyl-2P | DEG | DEG |
| Freezing point (degrees Celsius) | −68 | −68 | −48 | −48 | −23 | −68 | −68 |
| Specific gravity | 1.118 | 1.118 | 0.9866 | 0.9866 | 1.027 | 1.118 | 1.118 |
| (B) Blending amount of solvent (% by weight) | 100 | 50 | 100 | 50 | 100 | 50 | 10 |
| B/A = (Solvent)/(TMP) | 20 | 10 | 20 | 10 | 10 | 5 | 1 |
| Evaluation of accumulation | AA | AA | AA | AA | A | A | B |

| | COMOPARATIVE EXAMPLES | | | |
|---|---|---|---|---|
| | COM. EX. 1 | COM. EX. 2 | COM. EX. 3 | COM. EX. 4 |
| Ink | Ink 1 | Ink 2 | Ink 2 | Ink 2 |
| (A) Blending amount of TMP (% by weight) | 5 | 10 | 10 | 10 |
| Second liquid | 8 | 9 | 7 | 10 |
| Solvent | glycerol | urea | DEG | DEG |
| Freezing point (degrees Celsius) | 20 | 133 | −68 | −68 |
| Specific gravity | 1.26 | 1.335 | 1.118 | 1.118 |
| (B) Blending amount of solvent (% by weight) | 100 | 100 | 5 | 8 |
| B/A = (Solvent)/(TMP) | 20 | 10 | 0.5 | 0.8 |
| Evaluation of accumulation | C | C | C | C |

As indicated in TABLE 4, Examples 1 to 7 had satisfactory results in the evaluation of accumulation. In Example 6 in which the blending amount (B) of the specific solvent in the second liquid was not less than 5 times the blending amount (A) of the TMP in the ink, the result of the evaluation of accumulation was more excellent; and in Examples 1-4 in each of which the blending amount (B) of the specific solvent in the second liquid was not less than 10 times the blending amount (A) of the TMP in the ink particularly had excellent results in the evaluation of accumulation.

On the other hand, Comparative Examples 1 and 2 which contained glycerol and urea, instead of the specific solved, in the second liquids, respectively had unsatisfactory results in the evaluation of accumulation. Further, Comparative Examples 3 and 4 in each of which the blending amount (B) of the specific solvent in the second liquid was made to be 0.5 times or 0.8 time the blending amount (A) of the TMP in the ink also had unsatisfactory results in the evaluation of accumulation.

As described above, the liquid discharge recording apparatus of the present teaching is capable of suppressing the accumulation of the first liquid containing TMP. The usage of the liquid discharge recording apparatus of the present teaching is not particularly limited, and is widely applicable to a variety of kinds of ink jet recording.

What is claimed is:

1. A liquid discharge recording apparatus, comprising:

a first liquid containing trimethylolpropane;

a liquid discharge head configured to discharge the first liquid;

a second liquid containing a solvent of which freezing point is less than 20 degrees Celsius and of which specific gravity is not more than 1.12 and is smaller than a specific gravity of the first liquid; and an absorber which is configured to contain the second liquid and which is configured to absorb the first liquid exited from the liquid discharge head, wherein a blending amount (% by weight) of the solvent in the second liquid is not less than a blending amount (% by weight) of the trimethylolpropane in the first liquid.

2. The liquid discharge recording apparatus according to claim 1, wherein the freezing point of the solvent is less than 10 degrees Celsius.

3. The liquid discharge recording apparatus according to claim 1, wherein the freezing point of the solvent is less than 0 degrees Celsius.

4. The liquid discharge recording apparatus according to claim 1, wherein the solvent is at least one selected from the group consisting of polyhydric alcohol, glycol ether, a nitrogen-containing compound and fatty acid.

5. The liquid discharge recording apparatus according to claim 1, wherein the solvent is at least one selected from the group consisting of: diethylene glycol, triethylene glycol n-butyl ether, N-methyl-2-pyrrolidone, 1,5-pentanediol, 1,3-dimethyl-2-imidazolidinone, oleic acid, triethylene glycol, tetraethylene glycol n-butyl ether, propylene glycol n-butyl ether, dipropylene glycol n-butyl ether, tripropylene glycol n-butyl ether, dipropylene glycol n-propyl ether, and linoleic acid.

6. The liquid discharge recording apparatus according to claim 5, wherein the solvent is at least one of the diethylene glycol and the triethylene glycol n-butyl ether.

7. The liquid discharge recording apparatus according to claim 1, wherein not less than 10% by weight of the solvent is contained in the second liquid.

8. The liquid discharge recording apparatus according to claim 1, wherein the absorber is at least one of a flushing foam and a platen foam;

the flushing foam is arranged in a non-recording area of the liquid discharge recording apparatus and is configured to receive the first liquid discharged by the liquid discharge head at a position at which the liquid discharge head faces the flushing foam; and the platen foam is arranged in a recording area of the liquid discharge recording apparatus and is configured to receive the first liquid discharged by the liquid discharge head at a position at which the liquid discharge head faces the platen foam.

9. The liquid discharge recording apparatus according to claim 1, wherein the blending amount (% by weight) of the solvent in the second liquid is not less than 5 times the blending amount (% by weight) of the trimethylolpropane in the first liquid.

10. The liquid discharge recording apparatus according to claim 1, wherein the blending amount (% by weight) of the solvent in the second liquid is not less than 10 times the blending amount (% by weight) of the trimethylolpropane in the first liquid.

11. The liquid discharge recording apparatus according to claim 1, wherein the blending amount (% by weight) of the solvent in the second liquid is in a range of 1 time to 20 times the blending amount (% by weight) of the trimethylolpropane in the first liquid.

12. The liquid discharge recording apparatus according to claim 1, wherein not less than 50% by weight of the solvent is contained in the second liquid; and the blending amount (% by weight) of the solvent in the second liquid is in a range of 10 times to 20 times the blending amount (% by weight) of the trimethylolpropane in the first liquid.

13. The liquid discharge recording apparatus according to claim 1, wherein the second liquid is charged to the liquid discharge head and a liquid flow channel of the light discharge recording apparatus at a time of shipment of the liquid discharge recording apparatus; and the second liquid is absorbed to the absorber by being discharged from the liquid discharge head onto the absorber in a case that the first liquid for recording is introduced to the liquid discharge head and the liquid flow channel.

14. The liquid discharge recording apparatus according to claim 1, wherein the second liquid is contained in the absorber.

15. A liquid discharge recording apparatus, comprising:

a first liquid containing trimethylolpropane;

a liquid discharge head configured to discharge the first liquid;

a second liquid containing a solvent of which freezing point is less than 20 degrees Celsius and of which specific gravity is not more than 1.12; and an absorber which is configured to contain the second liquid and which is configured to absorb the first liquid exited from the liquid discharge head, wherein a blending amount (% by weight) of the solvent in the second liquid is not less than a blending amount (% by weight) of the trimethylolpropane in the first liquid, wherein the second liquid is composed only of the solvent.

16. A liquid discharge recording apparatus, comprising:

a first liquid containing trimethylolpropane;

a liquid discharge head configured to discharge the first liquid;

a second liquid containing a solvent of which freezing point is less than 20 degrees Celsius and of which specific gravity is not more than 1.12; and an absorber which is configured to contain the second liquid and which is configured to absorb the first liquid exited from the liquid discharge head, wherein a blending amount (% by weight) of the solvent in the second liquid is not less than a blending amount (% by weight) of the trimethylolpropane in the first liquid, wherein an amount of the second liquid contained in the absorber is in a range of not less than 0.10 $\mu g/mm^3$ to not more than 0.91 $\mu g/mm^3$.

17. The liquid discharge recording apparatus according to claim 16, wherein the amount of the second liquid contained in the absorber is in a range of not less than 0.20 $\mu g/mm^3$ to not more than 0.70 $\mu g/mm^3$.

* * * * *